US005747757A

United States Patent [19]

Van Zeeland et al.

[11] Patent Number: 5,747,757

[45] Date of Patent: May 5, 1998

[54] TAMPER RESISTANT MEMBRANE SWITCH

[75] Inventors: Anthony J. Van Zeeland, Mesa, Ariz.; Robert S. Bielik, Waukesha, Wis.

[73] Assignee: Monopanel Technologies, Inc., West Allis, Wis.

[21] Appl. No.: 711,507

[22] Filed: Sep. 10, 1996

[51] Int. Cl.[6] ..... H01H 13/70; H01H 1/10

[52] U.S. Cl. ..... 200/5 A; 200/512; 200/517

[58] Field of Search ..... 200/5 A, 159, 200/292, 516, 512, 517

[56] References Cited

U.S. PATENT DOCUMENTS

| | | | |
|---|---|---|---|
| 3,676,943 | 7/1972 | Kidd, Jr. et al. | 40/130 M |
| 4,065,649 | 12/1977 | Carter et al. | 200/5 A |
| 4,228,330 | 10/1980 | Larson . | |
| 4,303,811 | 12/1981 | Parkinson | 200/5 A |
| 4,317,013 | 2/1982 | Larson . | |
| 4,394,547 | 7/1983 | Larson . | |
| 4,551,586 | 11/1985 | Latasiewicz | 200/5 A |
| 4,580,018 | 4/1986 | Yoshihara | 200/5 A |
| 4,639,559 | 1/1987 | Taguchi . | |
| 4,771,139 | 9/1988 | DeSmet . | |
| 4,818,827 | 4/1989 | Ipcinski et al. . | |
| 4,901,074 | 2/1990 | Sinn et al. | 200/5 A |

OTHER PUBLICATIONS

PiezoPanel™ Product Brochure.

Technigraphics of Maryland, Inc., Baltimore, MD. *Electronics Products*, (Nov. 1994), Piezoelectric Switch Panels.

Interlink Electronics, Carpinteria, CA, *Interlink Electronics*, FSR™ Rugged Keypad.

*Primary Examiner*—Peter S. Wong
*Assistant Examiner*—Rajnikant B. Patel
*Attorney, Agent, or Firm*—Ryan, Maki, Mann & Hohenfeldt

[57] ABSTRACT

A tamper resistant membrane switch includes a backer plate and an overlying metal panel. Sandwiched between the backer plate and metal panel is a membrane switch subassembly. A plurality of spacers between the backer plate and metal panel separate the two but allow the metal panel to deflect toward the backer plate when external finger pressure is applied. Such deflection closes the underlying poles of the membrane switch subassembly to actuate the switch. The positioning and size of the spacers determines where deflection can occur and how much force is needed to actuate the switches. The overlying panel, being formed of solid metal over its entire surface, is resistant to damage from vandalism, thievery or other attack.

20 Claims, 3 Drawing Sheets

10
10
36
28
26
30
30
52
34
20
24
38
40
34
24
20
38
30
30
26
28
36
34

20
24
34
38
42
44
46
48
50
52
10
12
14

TAMPER RESISTANT MEMBRANE SWITCH

BACKGROUND OF THE INVENTION

This invention relates generally to membrane switches and, more particularly, to membrane switch assemblies that are used, for example, on vending machines, washing machines or other devices made available for use by members of the public in a commercial or business setting.

Membrane switches are well-known in the electrical switch art. Such switches are frequently used in flush panel controls and typically include a membrane supported over and spaced from a substrate. Finger pressure applied to the switch pushes a conductive pad on the membrane into contact with a similar pad on the substrate. Contact between the pads closes the switch and completes the electrical circuit. Membrane switches are particularly well-suited for use in certain environments wherein it is desired to seal an electronic system against moisture, dust etc.

One application in which membrane switches have particular utility is in commercial vending machines, laundromat washing machines and the like. Such machines, which are typically left unattended in publicly accessible areas, are the frequent targets of thieves and vandals. One approach to combating thievery and vandalism centers on improving the physical integrity of the machine itself, thereby making it harder for lawbreakers to break into or otherwise physically damage the machine. Electrical switches and controls, which, necessarily, must remain responsive to relatively light input forces applied by legitimate users, are particularly vulnerable to damage by thieves and vandals. Although membrane switches are advantageous in that they eliminate protruding knobs, buttons and levers that are easily broken, such membrane switches have, until now, employed exposed plastic films and overlays that were susceptible to physical or cosmetic damage when subjected to vandalous attack. For commercial operators who lose money when machines are not in operating condition, "down time" due to vandalism or even ordinary wear and tear is a significant concern.

SUMMARY OF THE INVENTION

The invention provides a membrane switch assembly having a backer plate, a membrane switch subassembly disposed over the backer plate and a metallic overlay disposed over the membrane switch subassembly.

The invention also provides a membrane switch assembly including a backer plate, a membrane switch subassembly disposed over the backer plate and a protective, tamper-resistant overlay disposed over the membrane switch subassembly.

The invention also provides a tamper resistant membrane switch assembly including a substantially rigid backer plate defining a substantially planar upper surface and a plurality of standoffs adjacent the upper surface of the backer plate arranged so as to divide the upper surface of the backer plate into a plurality of switch-element receiving cells. The assembly further includes a plurality of membrane switch elements disposed over the upper surface of the backer plate and received in the switch-element receiving cells. A substantially rigid, substantially planar protective panel overlies the backer plate and the membrane switch elements. The protective panel is supported by the standoffs in the regions between the switch-element receiving cells and is unsupported in the regions over the switch-element receiving cells so as to be deformable toward the backer plate and into contact with individual ones of the membrane switch elements substantially in the regions over the switch-element receiving cells.

It is an object of the present invention to provide a new and improved membrane switch assembly.

It is a further object of the invention to provide a new and improved membrane switch assembly that is durable and free of knobs, buttons or exposed, physically delicate structures.

It is a further object of the invention to provide a new and improved membrane switch assembly that is suited for use in unattended, publicly accessible machines that are often the targets of vandalous attack.

It is a further object of the invention to provide a tamper resistant membrane switch assembly that is effective in use, that is relatively immune to false actuation and that is economical in manufacture.

BRIEF DESCRIPTION OF THE DRAWINGS

The features of the invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
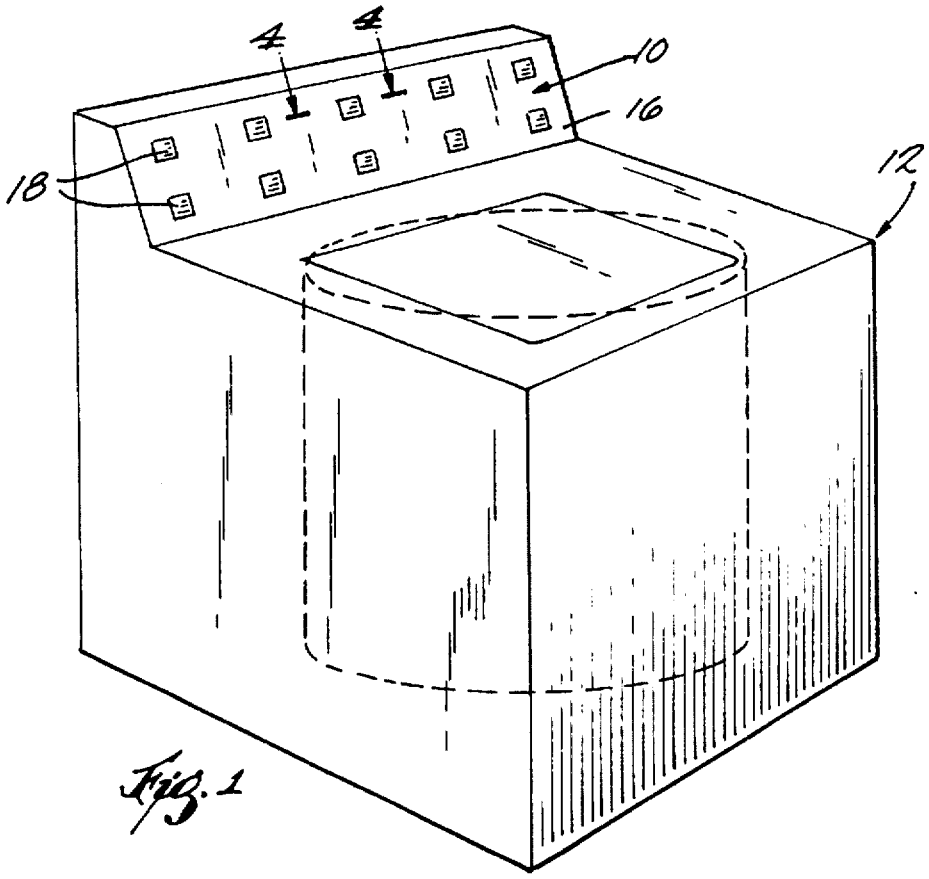
FIG. 1 is a perspective view of a coin-operated, commercial-duty washing machine having a tamper resistant membrane switch assembly embodying various features of the invention.

Referring to the drawings, and, in particular, to FIG. 1, a tamper resistant membrane switch assembly 10 embodying various features of the invention is shown. As illustrated, the switch assembly 10 is shown in the context of a commercial, coin-operated washing machine 12 of the type commonly found in Laundromats. Such machines are often left unattended in publicly accessible area where they are frequently the targets of vandalism or attempted thievery. Other types of machines, such as coin-operated vending machines, telephones etc., are also subject to similar attack. Accordingly, it will be understood that the washing machine 12 is only one example of the type of device in which the switch assembly 10 can be used to advantage. It will be appreciated that the switch assembly 10 can be effectively used in a variety of other applications as well.

The tamper resistant membrane switch assembly 10 provides a generally planar, uniform and continuous outer surface 16 that is substantially impervious to physical attack. At the same time, the switch assembly permits convenient user-control over machine operation through a plurality of manually actuable individual switches 18. The individual switches are not separate elements mounted on the outer surface 16, but, rather, comprise particular regions on the surface. When a pre-designated region on the outer surface is pushed or pressed, a desired control effect is achieved. In accordance with one aspect of the invention, the desired control effects are not actuated if the surface 16 is pushed or pressed in areas other than the pre-designated regions comprising the individual switches 18.

Figure 2:
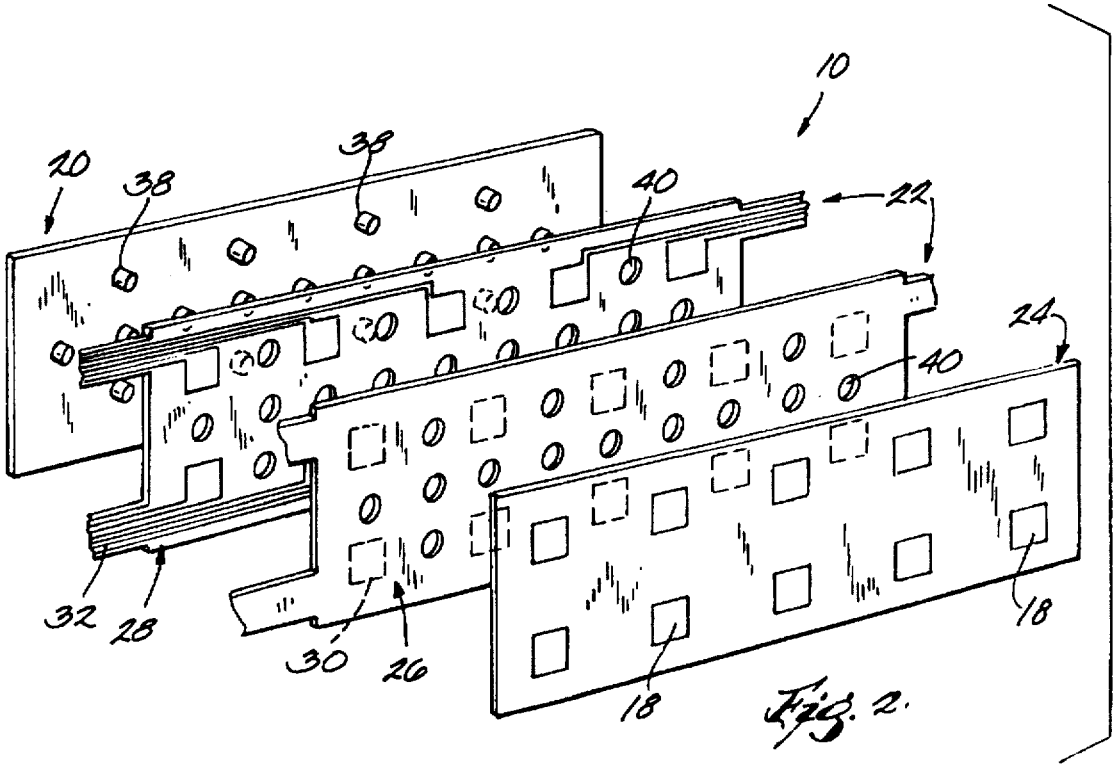
FIG. 2 is an exploded perspective view of the tamper resistant membrane switch assembly shown in FIG. 1.

Referring to the exploded view of FIG. 2, the tamper resistant membrane switch 10 includes a backer plate 20, a membrane switch subassembly 22 disposed over the backer plate 20 and a protective, durable, substantially continuous and substantially planar overlay 24 disposed over the membrane switch subassembly 22. In the illustrated embodiment, the overlay comprises a rigid, durable, yet partially deformable metal sheet or panel, formed, for example, from approximately 0.030 inch stainless steel or aluminum. It will be appreciated that other durable materials, such as Lucite, Kevlar or tempered glass, can also be advantageously used as the overlay 24.

The membrane switch subassembly 22 includes a membrane 26 disposed over a substrate 28. Conductive pads 30 are deposited onto the membrane 26 and the substrate 28 using known techniques, as are conductive runners 32. The conductive pads 30 are arranged so that they overlap or overlie each other in pairs. Conductive pads that overlie each other form a switch element 34 (FIG. 3) that can be actuated independently of the switch elements formed by the remaining pads. The runners 32 interconnect the switch elements 34 with the outside world.

Figures 3, 4, 5:
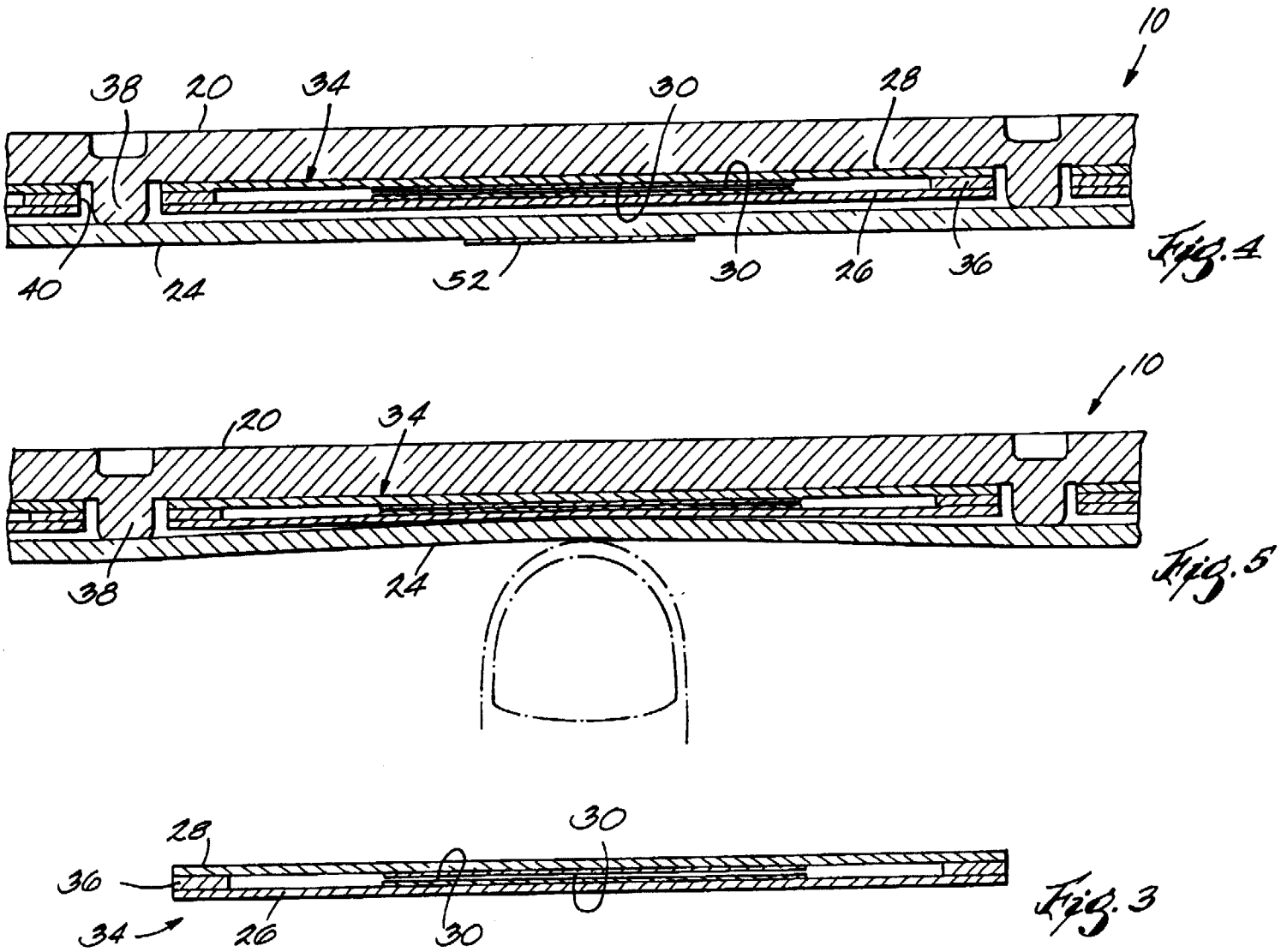
FIG. 3 is a sectional view of a typical membrane switch element used at various locations in the tamper resistant membrane switch, useful in understanding the operation thereof.
FIG. 4 is a sectional view of the tamper resistant membrane switch shown in FIG. 1 taken along line 4—4 thereof.
FIG. 5 is a sectional view, similar to FIG. 4, showing the switch in an actuated condition.

In accordance with known membrane switch techniques, and as illustrated in FIG. 3, the opposed conductive pads 30 of the membrane 26 and substrate 28 are ordinarily held out of contact with each other by means of a spacer layer 36. The pads 30, however, are brought into contact to complete a circuit when they are pressed together. The particular type of membrane switch technology employed is not critical to the invention, and a variety of membrane switch subassemblies 22 can be used.

In further accordance with the invention, and referring further to FIGS. 2 and 4, a plurality of standoffs 38 are disposed between the backer plate 20 and the overlay 24. These standoffs 38, which in the figures are shown exaggerated in size for clarity, ordinarily keep the overlay spaced sufficiently from the backer plate 20 to avoid actuating the individual switch elements 34 of the membrane switch subassembly 22. Preferably, the standoffs 38 are located so as to define areas or cells for receiving the switch elements. Preferably the standoffs 38 are located between the cells so that the overlay 24 is supported in the areas between the cells but is unsupported in the areas over the cells.

As best seen in FIGS. 4 and 5, the standoffs 38 hold the overlay 24 away from the backer plate 20 and the switch element 34 when no external forces are applied (FIG. 4), but permit the overlay to flex inwardly when pressed (FIG. 5) and thereby actuate the switch element 34. The standoffs 38, being located between the various switch receiving cells, substantially keep the overlay from flexing between the cells. This helps ensure that the various switch elements 34 are actuated only when an external force is applied directly over the switch element and not when an off-center force is applied.

As further illustrated in FIGS. 4 and 5, the standoffs 38 can be integrally formed on the backer plate 20 by embossing them from the rear. The standoffs 38 project through appropriately sized and located holes 40 formed in the membrane 26 and substrate 28. Although round, post-like standoffs 38 arranged in a rectangular or square pattern are shown for illustrative purposes, it will be appreciated that the standoffs 38 can be formed into other configurations ranging, for example, from simple posts at the edges of the active switch area to full scale ridges around the perimeter of the switch.

Figures 6, 7, 8, 9, 10, 11, 12, 13, 14:
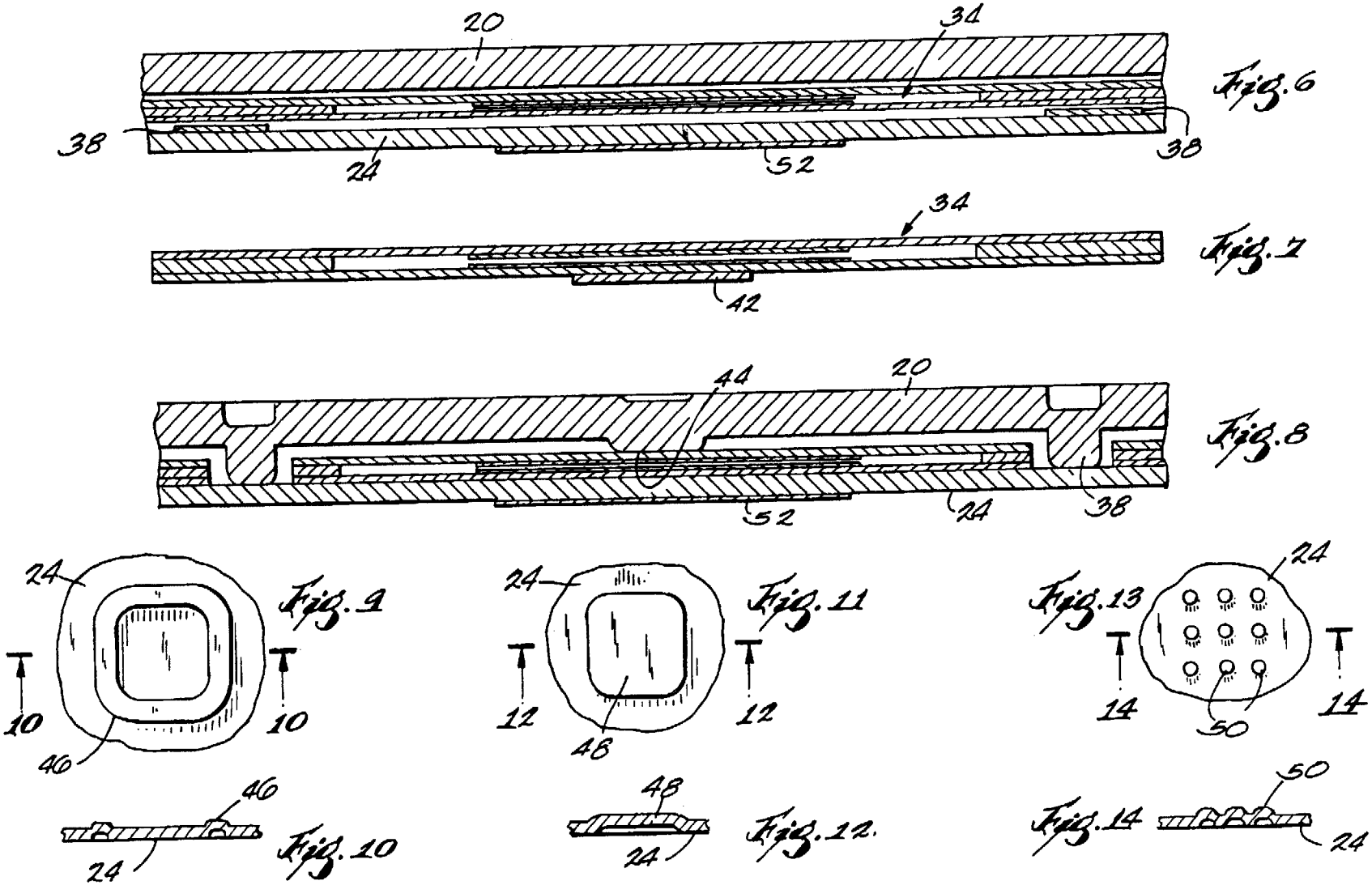
FIG. 6 is a sectional view of another embodiment of a tamper resistant membrane switch embodying various features of the invention.
FIG. 7 is a sectional view of still another embodiment of a tamper resistant membrane switch embodying various features of the invention.
FIG. 8 is a sectional view of still another embodiment of a tamper resistant membrane switch embodying various features of the invention.
FIG. 9 is a plan view of an alternate embodiment of a metal front plate or overlay used in a tamper resistant membrane switch embodying various features of the invention.
FIG. 10 is a sectional view of the metal front plate shown in FIG. 9 taken along line 10—10 thereof.
FIG. 11 is a plan view of another alternate embodiment of a metal front plate or overlay used in a tamper resistant membrane switch embodying various features of the invention.
FIG. 12 is a sectional view of the metal front plate shown in FIG. 11 taken along line 12—12 thereof.
FIG. 13 is a plan view of still another alternate embodiment of a metal front plate or overlay used in a tamper resistant membrane switch embodying various features of the invention.
FIG. 14 is a sectional view of the metal front plate shown in FIG. 13 taken along line 14—14 thereof.

Various alternatives to the configuration shown in FIGS. 1–5 can be used. An alternative to forming the standoffs 38 on the backer plate 20 is to provide them, for example, on the front surface of the membrane 26 and over the spacer layer 36 as shown in FIG. 6.

The actuation model of the tamper resistant membrane switch 20 closely approximates that of a flexing beam, at least in cross-section. In some cases, it is desirable that the contact point between the overlay 24 and the membrane 26 be concentrated at the center of the switch element 34. To achieve this, a thin additional, or actuator, standoff 42 can be adhesively bonded to the top surface of the membrane 26 as shown in FIG. 7. Similar results can be achieved by embossing a center post 44 into the backer plate 20 at the center of the switch element 34 as shown in FIG. 8. Similar results can also be achieved by embossing the overlay 24. To this end, the overlay 24 can, for example, be provided with ring embossing 46 as shown in FIGS. 9 and 10, pillow embossing 48 as shown in FIGS. 11 and 12 or Braille embossing 50 as shown in FIGS. 13 and 14. Generally speaking, a standoff of some sort could also be applied as a discrete component or screened to the backer plate 20 or overlay 24 in place of the integrally formed actuator standoffs shown in the figures. Either concept will provide the effect of concentrating the force in the center of the switch.

Preferably, the membrane switch elements 34 have relatively large active areas. This provides a large target area for switching and further provides relatively low intrinsic switch actuation forces. Low intrinsic switch actuation forces are desirable in that these are added to the forces needed to deflect the overlay. Thus, reasonable overall switch actuation forces are best achieved if intrinsic switch actuation forces are kept low.

Preferably, the overlay 24 is "floated" to allow the switch actuation mechanism to be one of deflection rather than tensile stress. Similarly, the membrane switch subassembly 22 is not bonded to the backer plate 20 in order to avoid spontaneous actuation or buckling of the switch layers 26, 28 resulting from differential expansion effects due to temperature or moisture. For positioning, the membrane switch subassembly may be tacked.

Preferably, functional indicia, graphics or other labeling 52 are screened onto the front or back of the overlay 24 depending upon whether the overlay is transparent or opaque. The graphics can also be applied to a film layer that is bonded to the front surface of the overlay.

It will be appreciated that the tamper resistant membrane switch 10 disclosed herein provides a continuous, durable outer operating surface that is free of knobs, buttons or other projections that are vulnerable to vandalous attack. Accordingly, the tamper resistant membrane switch 10 is well suited for applications in which the potential for physical abuse exists. It will also be appreciated that, although the invention is well suited for use in applications where tamper resistance is desired, the invention is also well suited for use wherein tamper resistance is not of concern and where the primary desire is the esthetic effect provided by the brushed aluminum or stainless steel look provided by the invention.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

I claim:

1. A membrane switch assembly comprising:

a backer plate;

a membrane switch subassembly disposed over the backer plate, the membrane switch subassembly including a plurality of individual switch elements;

a metallic overlay disposed over the membrane switch subassembly and deflectable toward the backer plate in response to an applied actuating force, and structure between the backer plate and the metallic overlay for confining deflection of the metallic overlay to areas substantially adjacent the applied actuating force so that substantially only single ones of the individual switch elements are actuated in response to application of the actuating force.

2. A membrane switch assembly as defined in claim 1 wherein the structure comprises a plurality of standoffs between the backer plate and the metallic overlay for spacing the metallic overlay from the backer plate with the membrane switch subassembly between the backer plate and the metallic overlay.

3. A membrane switch assembly as defined in claim 2 wherein the standoffs are integrally formed on the backer plate.

4. A membrane switch assembly as defined in claim 2 wherein the standoffs are bonded to the backer plate.

5. A membrane switch assembly as defined in claim 2 wherein the standoffs are disposed on the metallic overlay.

6. A membrane switch assembly as defined in claim 2 wherein the standoffs are disposed on the membrane switch subassembly.

7. A membrane switch assembly as defined in claim 1 further comprising an actuating standoff interposed between the backer plate and the metallic overlay and engageable with the membrane switch subassembly.

8. A membrane switch assembly as defined in claim 7 wherein the actuating standoffs are disposed substantially adjacent the center of each of the individual switch elements.

9. A membrane switch assembly as defined in claim 8 wherein the actuating standoffs are carried on the backer plate.

10. A membrane switch assembly as defined in claim 7 wherein the actuating standoffs are carried on the metallic overlay.

11. A membrane switch assembly as defined in claim 7 wherein the actuating standoffs are carried on the membrane switch subassembly.

12. A membrane switch assembly comprising:

a backer plate;

a membrane switch subassembly disposed over the backer plate, the membrane switch subassembly including a plurality of individual switch elements;

a protective, tamper-resistant overlay disposed over the membrane switch subassembly and deflectable toward the backer plate in response to an applied actuating force, and structure between the backer plate and the overlay for confining deflection of the overlay to areas substantially adjacent the applied actuating force so that substantially only single ones of the individual switch elements are actuated in response to application of the actuating force.

13. A membrane switch assembly as defined in claim 12 wherein the tamper-resistant overlay is formed of stainless steel.

14. A membrane switch assembly as defined in claim 12 wherein the tamper-resistant overlay is formed of aluminum.

15. A membrane switch assembly as defined in claim 13 wherein the tamper-resistant overlay is formed of a rigid, durable plastic.

16. A membrane switch assembly as defined in claim 12 wherein the tamper-resistant overlay is formed of tempered glass.

17. A tamper resistant membrane switch assembly comprising:

a substantially rigid backer plate defining a substantially planar upper surface;

a plurality of standoffs adjacent the upper surface of the backer plate and arranged so as to divide the upper surface of the backer plate into a plurality of switch-element receiving cells;

a plurality of membrane switch elements disposed over the upper surface of the backer plate and received in the switch-element receiving cells; and a substantially rigid, substantially planar protective panel overlying the backer plate and the membrane switch elements, the protective panel being supported by the standoffs in the regions between the switch-element receiving cells and unsupported in the regions over the switch-element receiving cells so as to be deformable toward the backer plate and into contact with individual ones of the membrane switch elements substantially in the regions over the switch-element receiving cells.

18. A tamper resistant membrane switch assembly as defined in claim 17 wherein the standoffs comprise posts.

19. A tamper resistant membrane switch assembly as defined in claim 17 wherein the standoffs comprise ridges around the switch-element receiving cells.

20. A tamper resistant membrane switch assembly as defined in claim 17 wherein the protective panel is embossed in the regions overlying the switch-element receiving cells.

* * * * *